US011395540B1

(12) United States Patent
Ramos

(10) Patent No.: US 11,395,540 B1
(45) Date of Patent: Jul. 26, 2022

(54) RAIL-MOUNTED TABLETOP

(71) Applicant: Jesus Ramos, Somerville, NJ (US)

(72) Inventor: Jesus Ramos, Somerville, NJ (US)

( * ) Notice: Subject to any disclaimer, the term of this patent is extended or adjusted under 35 U.S.C. 154(b) by 88 days.

(21) Appl. No.: 17/008,761

(22) Filed: Sep. 1, 2020

(51) Int. Cl.
*A47B 5/00* (2006.01)
*A47B 5/02* (2006.01)
*E04F 11/18* (2006.01)

(52) U.S. Cl.
CPC ..... *A47B 5/02* (2013.01); *E04F 11/18* (2013.01); *E04F 2011/1868* (2013.01)

(58) Field of Classification Search
CPC ..... E04F 11/18; E04F 2011/1868; A47B 5/02
See application file for complete search history.

(56) References Cited

U.S. PATENT DOCUMENTS 1,571,753 A * 2/1926 Christian ..... A47B 31/06 108/47
3,741,131 A * 6/1973 Leadbetter ..... A47B 5/02 108/97
4,570,803 A * 2/1986 Peterson ..... A47B 5/02 108/47
5,033,448 A * 7/1991 Sandweg ..... A47J 37/0786 126/25 R
6,931,998 B1 * 8/2005 Leese ..... A47B 5/02 108/152
7,121,213 B2 10/2006 Viazanko
9,814,305 B2 11/2017 Brus
9,936,801 B1 * 4/2018 Allen ..... A47B 5/02
D853,766 S 7/2019 Eppich
2006/0180058 A1 * 8/2006 Monson ..... A47B 5/02 108/152
2007/0101908 A1 * 5/2007 Makita ..... A47B 5/02 108/47
2009/0000523 A1 1/2009 Ciardelli
2009/0020047 A1 * 1/2009 Noble ..... A47B 23/04 108/157.1
2009/0026342 A1 * 1/2009 Bochner ..... A47B 5/04 248/460
2018/0160800 A1 * 6/2018 Symalla ..... A47B 13/081

FOREIGN PATENT DOCUMENTS

CA 2967213 5/2017

* cited by examiner

*Primary Examiner* — Matthew W Ing
(74) *Attorney, Agent, or Firm* — Kyle A. Fletcher, Esq.

(57) ABSTRACT

The rail-mounted tabletop is a table. The rail-mounted tabletop is configured for use with a fence. The fence incorporates a rail, a plurality of pickets and posts, and a supporting surface. The plurality of pickets and posts elevate the rail above the supporting surface. The plurality of pickets and posts forms the load path that transfers the load of the rail-mounted tabletop to the supporting surface. The rail-mounted tabletop is suspended from the rail of the fence. The rail-mounted tabletop is a table incorporates a counter plate, a bracing plate and a rail hook. The supporting plate and the rail hook attach to the counter plate. The counter plate forms a horizontally oriented supporting surface. The rail hook suspends the counter plate and the bracing plate from the rail. The bracing plate braces the counter plate against the plurality of pickets and posts.

20 Claims, 6 Drawing Sheets

RAIL-MOUNTED TABLETOP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including tables, more specifically, a detachable wall table.

SUMMARY OF INVENTION

The rail-mounted tabletop is a table. The rail-mounted tabletop is configured for use with a fence. The fence comprises a rail, a plurality of pickets and posts, and a supporting surface. The plurality of pickets and posts elevate the rail above the supporting surface. The plurality of pickets and posts forms the load path that transfers the load of the rail-mounted tabletop to the supporting surface. The rail-mounted tabletop is suspended from the rail of the fence. The rail-mounted tabletop is a table comprises a counter plate, a bracing plate and a rail hook. The supporting plate and the rail hook attach to the counter plate. The counter plate forms a horizontally oriented supporting surface. The rail hook suspends the counter plate and the bracing plate from the rail. The bracing plate braces the counter plate against the plurality of pickets and posts.

These together with additional objects, features and advantages of the rail-mounted tabletop will be readily apparent to those of ordinary skill in the art upon reading the following detailed description of the presently preferred, but nonetheless illustrative, embodiments when taken in conjunction with the accompanying drawings.

In this respect, before explaining the current embodiments of the rail-mounted tabletop in detail, it is to be understood that the rail-mounted tabletop is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rail-mounted tabletop.

It is therefore important that the claims be regarded as including such equivalent construction insofar as they do not depart from the spirit and scope of the rail-mounted tabletop. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
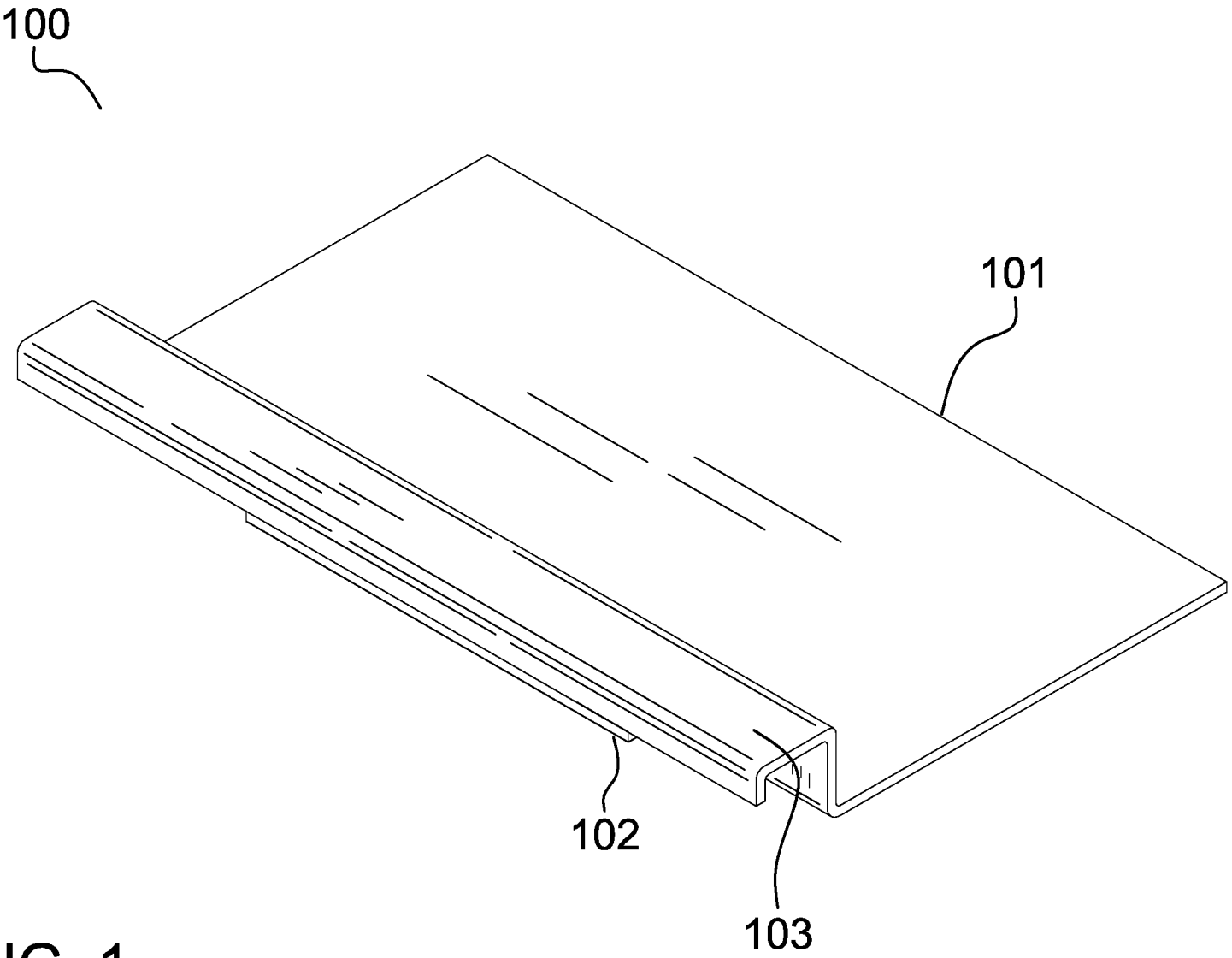
FIG. 1 is a superior perspective view of an embodiment of the disclosure.
Figure 2:
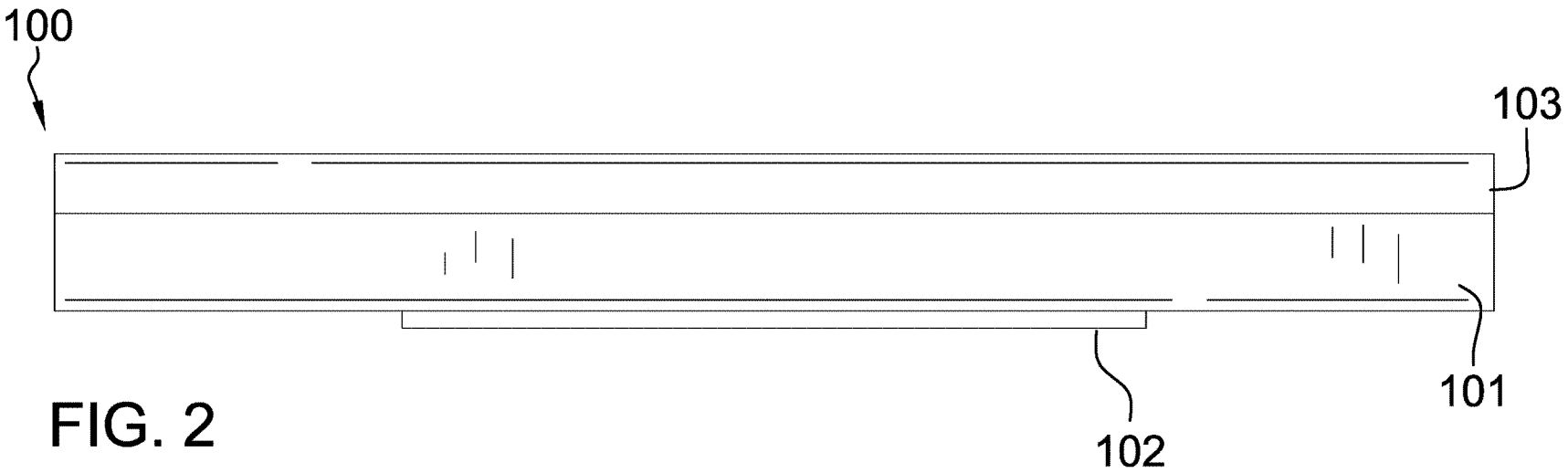
FIG. 2 is a front view of an embodiment of the disclosure.
Figure 3:
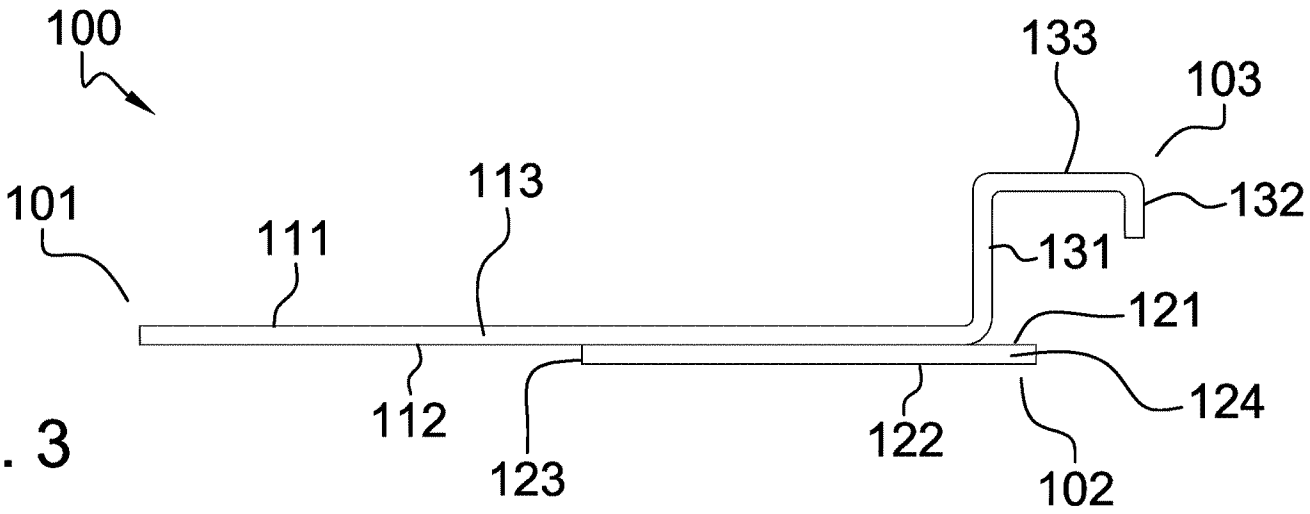
FIG. 3 is a side view of an embodiment of the disclosure.
Figure 4:
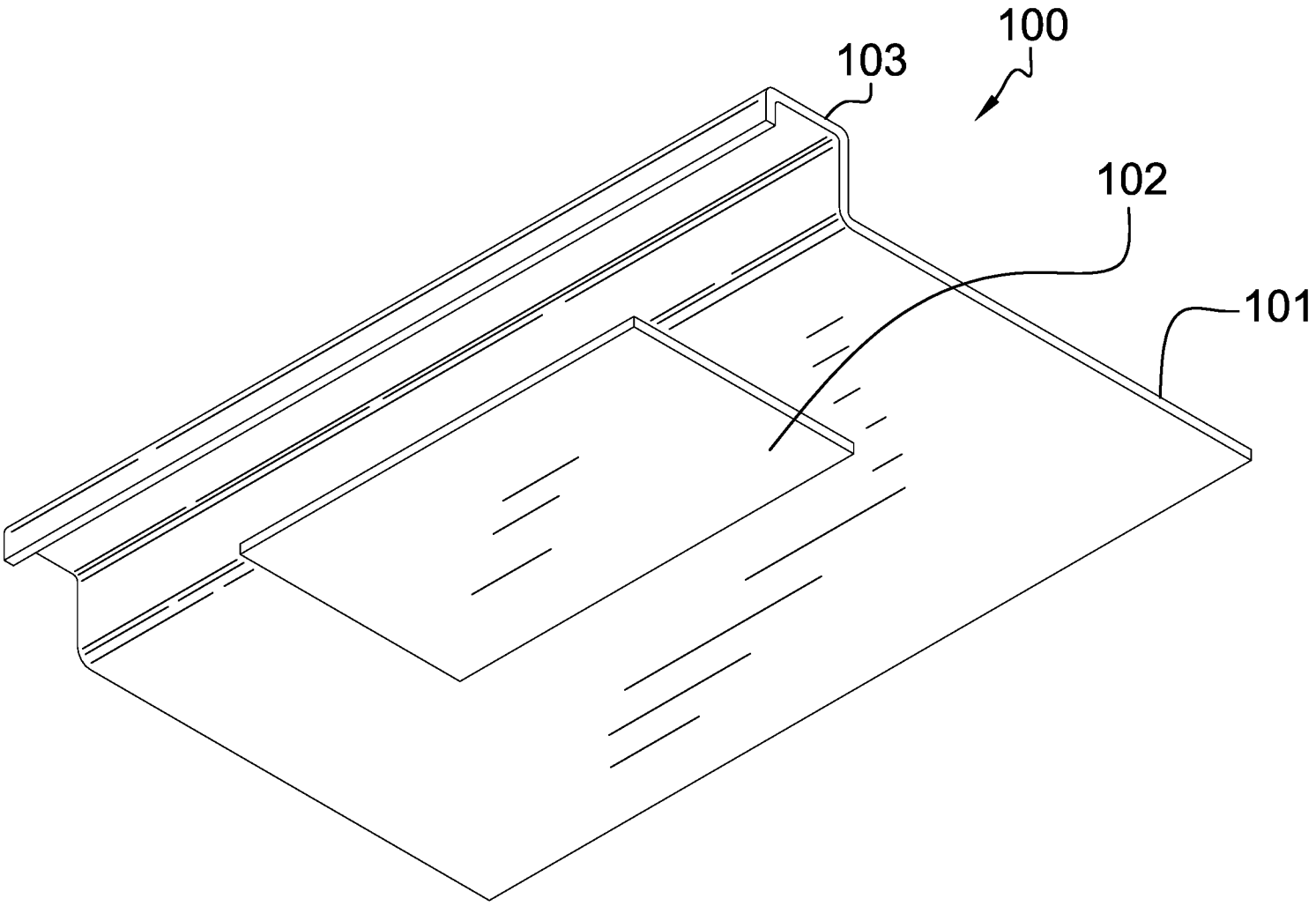
FIG. 4 is an inferior perspective view of an embodiment of the disclosure.
Figure 5:
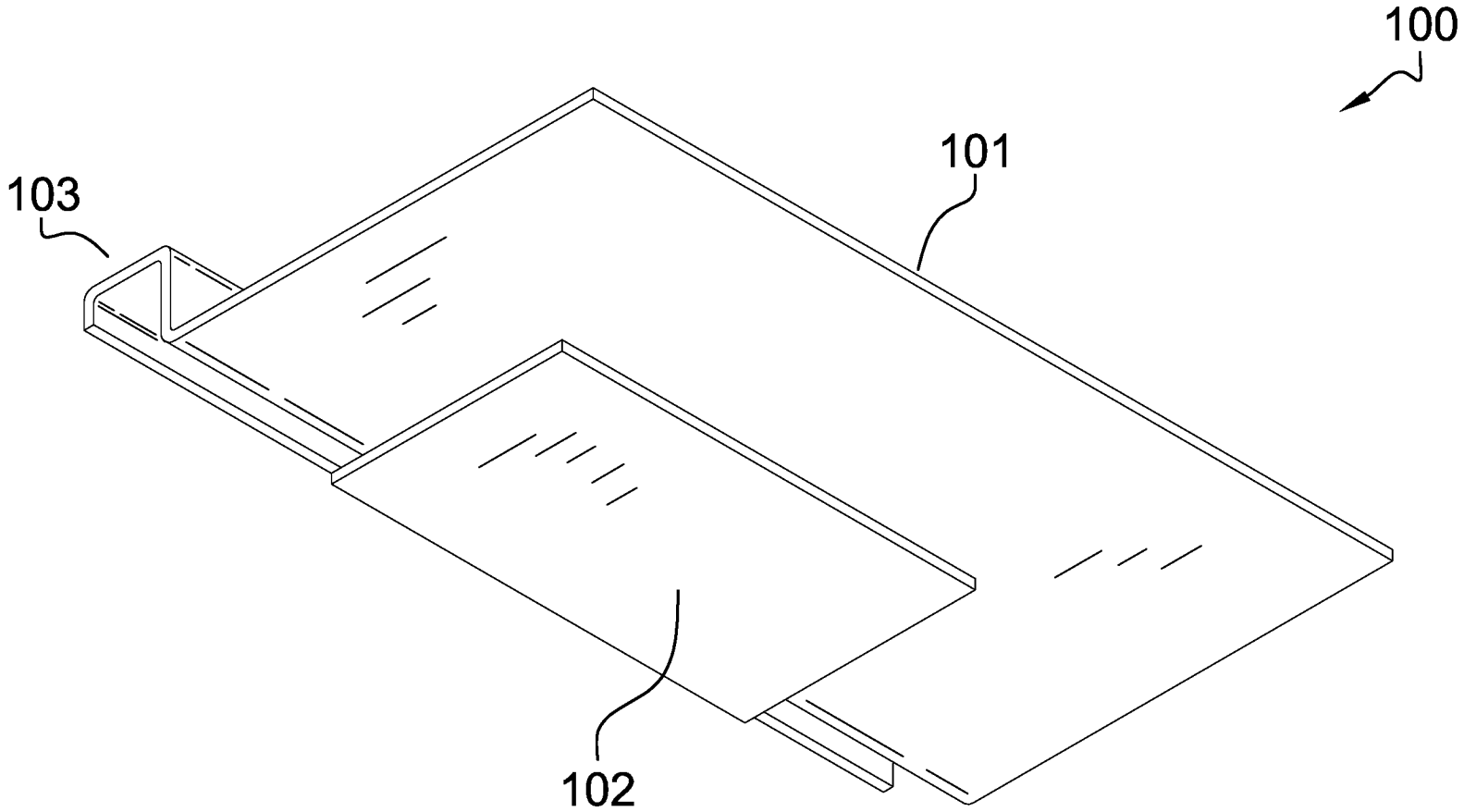
FIG. 5 is a reverse inferior perspective view of an embodiment of the disclosure.
Figure 6:
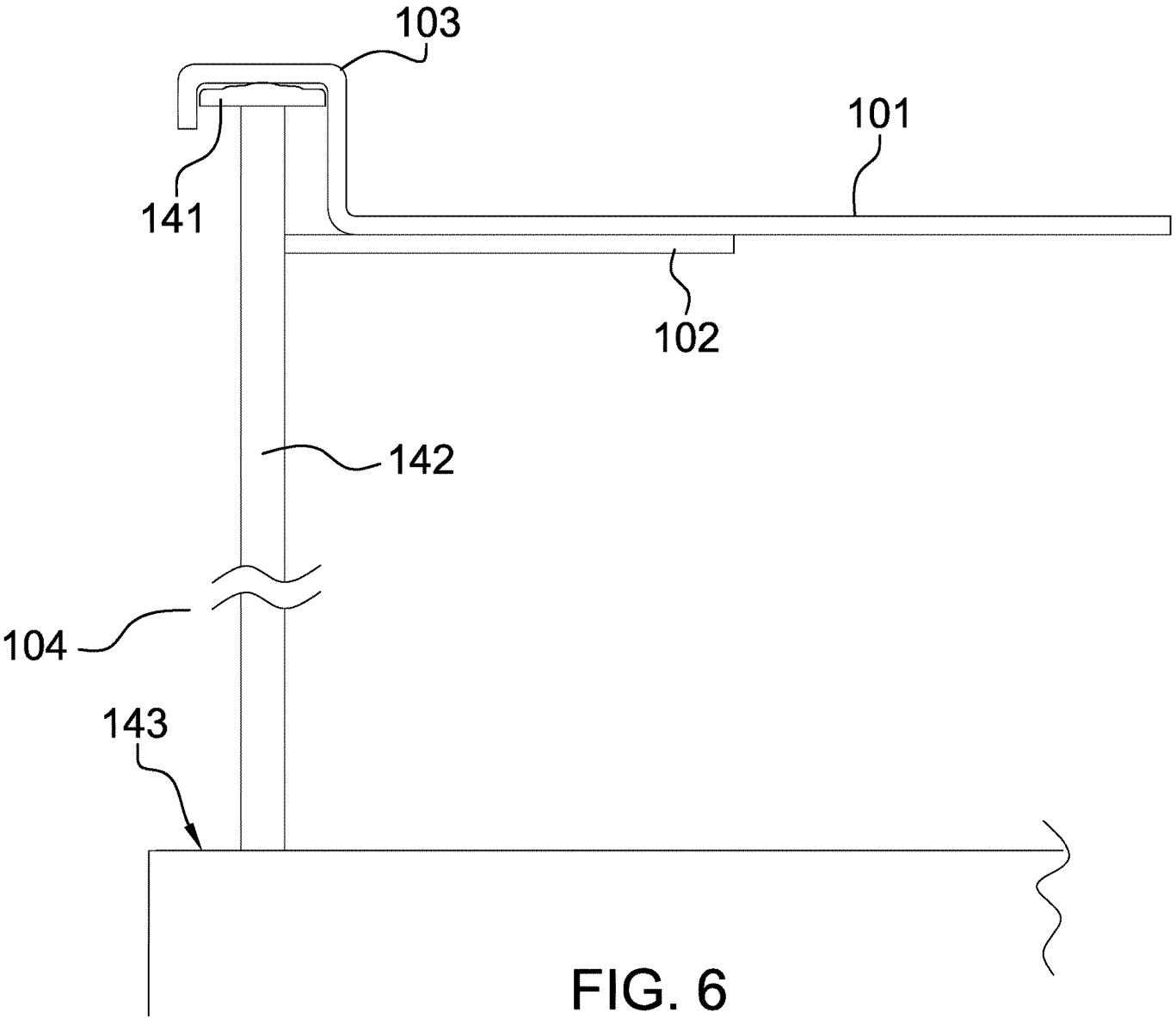
FIG. 6 is an in-use view of an embodiment of the disclosure.
Figure 7:
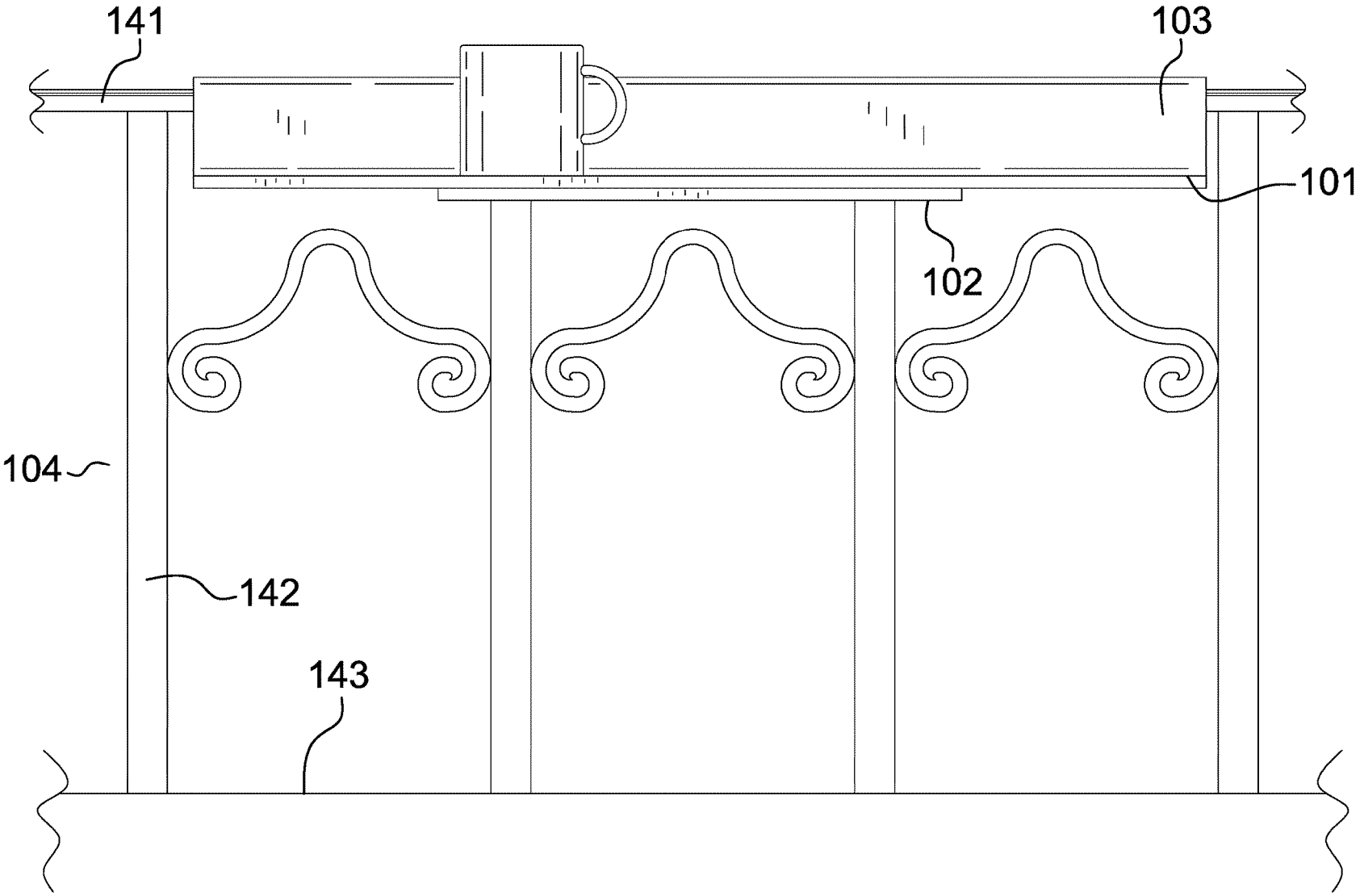
FIG. 7 is an in-use view of an embodiment of the disclosure.

Detailed reference will now be made to one or more potential embodiments of the disclosure, which are illustrated in FIGS. 1 through 7.

The rail-mounted tabletop 100 (hereinafter invention) is a table. The invention 100 is configured for use with a fence 104. The fence 104 comprises a rail 141, a plurality of pickets and posts 142, and a supporting surface 143. The plurality of pickets and posts 142 elevate the rail 141 above the supporting surface 143. The plurality of pickets and posts 142 forms the load path that transfers the load of the invention 100 to the supporting surface 143. The invention 100 is suspended from the rail 141 of the fence 104. The invention 100 is a table comprises a counter plate 101, a bracing plate 102, and a rail hook 103. The supporting plate and the rail 141 hook 103 attach to the counter plate 101. The counter plate 101 forms a horizontally oriented supporting surface 143. The rail 141 hook 103 suspends the counter plate 101 and the bracing plate 102 from the rail 141. The bracing plate 102 braces the counter plate 101 against the plurality of pickets and posts 142.

The fence 104 is a vertically oriented boundary structure. The fence 104 forms the final link of the load path that transfers the load of the invention 100 to the supporting surface 143. The fence 104 is defined elsewhere in this disclosure. The rail 141 is a rigid prism-shaped structure that forms the superior structure of the fence 104. The rail 141 is defined elsewhere in this disclosure. The plurality of pickets and posts 142 forms the structure of the fence 104 that elevates the rail 141 above the supporting surface 143. The plurality of pickets and posts 142 is defined elsewhere in this disclosure. The supporting surface 143 is defined elsewhere in this disclosure.

The counter plate 101 is a prism-shaped structure. The counter plate 101 has a disk structure. The counter plate 101 is a rigid structure. The counter plate 101 forms a horizontal surface used to support objects in a position elevated above the supporting surface 143. The counter plate 101 comprises a first superior face 111, a first inferior face 112, and a first plurality of lateral faces 113.

The first superior face 111 is a congruent end of the disk structure of the counter plate 101. The first superior face 111 forms the horizontal surface used to support objects in a position elevated above the supporting surface 143.

The first inferior face 112 is a congruent end of the disk structure of the counter plate 101. The first inferior face 112 is the congruent end of the disk structure of the counter plate 101 that is distal from the first superior face 111. The first inferior face 112 is the congruent end of the disk structure of the counter plate 101 that is proximal to the supporting surface 143. The bracing plate 102 attaches to the first inferior face 112 of the counter plate 101.

The first plurality of lateral faces 113 form the lateral faces of the disk structure of the counter plate 101. The first plurality of lateral faces 113 form the perimeter of the counter plate 101.

The bracing plate 102 is a prism-shaped structure. The bracing plate 102 has a disk structure. The bracing plate 102 is a rigid structure. The bracing plate 102 forms the inferior structure of the invention 100. The bracing plate 102 attaches to the counter plate 101 such that the bracing plate 102 projects beyond the first plurality of lateral faces 113 of the counter plate 101 to form an undercut ledge 124 structure.

The bracing plate 102 and the counter plate 101 are positioned relative to the rail 141 hook 103 such that the center of mass of the invention 100 is not positioned on the plane formed by the fence 104. This offset position of the center of mass of the invention 100 causes the first inferior face 112 of the counter plate 101 and the second inferior face 122 of the bracing plate 102 to rotate in an inferior direction towards the plurality of pickets and posts 142 of the fence 104.

By positioning the bracing plate 102 to form an undercut ledge 124 relative to the counter plate 101, a lateral face selected from the second plurality of lateral faces 123 of the bracing plate 102 will press into the plurality of pickets and posts 142 of the fence 104 such that the bracing plate 102 prevents the rotation of the counter plate 101 such that the first superior face 111 of the disk structure of the counter plate 101 maintains a horizontal orientation.

The bracing plate 102 comprises a second superior face 121, a second inferior face 122, and a second plurality of lateral faces 123. The bracing plate 102 attaches to the counter plate 101 to form an undercut ledge 124.

The second superior face 121 is a congruent end of the disk structure of the bracing plate 102. The second superior face 121 forms the surface of the bracing plate 102 that attaches to the first inferior face 112 of the counter plate 101.

The second inferior face 122 is a congruent end of the disk structure of the bracing plate 102. The second inferior face 122 is the congruent end of the disk structure of the bracing plate 102 that is distal from the second superior face 121. The second inferior face 122 is the congruent end of the disk structure of the bracing plate 102 that is proximal to the supporting surface 143. The second inferior face 122 forms the inferior surface of the invention 100.

The second plurality of lateral faces 123 form the lateral faces of the disk structure of the bracing plate 102. The second plurality of lateral faces 123 form the perimeter of the bracing plate 102. The second superior face 121 of the bracing plate 102 attaches to the first inferior face 112 of the counter plate 101 such that a portion of the perimeter formed by the second plurality of lateral faces 123 extends beyond the region that is bounded by the first plurality of lateral faces 113.

The portion of the second plurality of lateral faces 123 of the bracing plate 102 that extends beyond the boundary formed by the first plurality of lateral faces 113 of the counter plate 101 forms the undercut ledge 124 structure of the bracing plate 102. The portions of the undercut ledge 124 that are distal from the first plurality of lateral faces 113 of the counter plate 101 forms the surfaces of the second plurality of lateral faces 123 of the bracing plate 102 that braces the invention 100 by resting against the plurality of pickets and posts 142 of the fence 104. The undercut ledge 124 is further defined elsewhere in this disclosure.

The rail 141 hook 103 is a mechanical structure. The rail 141 hook 103 is a c-channel structure. The rail 141 hook 103 forms the superior structure of the invention 100. The rail 141 hook 103 attaches the counter plate 101 and the bracing plate 102 to the rail 141 of the fence 104. The rail 141 hook 103 forms the load path that transfers the load of the counter plate 101 and the bracing plate 102 to the rail 141 of the fence 104. The rail 141 hook 103 attaches to the rail 141 by inserting the rail 141 into the hollow interior of the c-channel structure of the rail 141 hook 103. The rail 141 hook 103 suspends the counter plate 101 and the bracing plate 102 from the rail 141.

The rail 141 hook 103 comprises a first arm 131, a second arm 132, and a crossplate 133. The first arm 131 forms the first arm 131 of the u-shaped structure characteristic of a c-channel structure such as the rail 141 hook 103. The second arm 132 forms the second arm 132 of the u-shaped structure characteristic of a c-channel structure such as the rail 141 hook 103. The crossplate 133 forms the crossbeam of the u-shaped structure characteristic of a c-channel structure such as the rail 141 hook 103.

The first arm 131 is a prism-shaped structure. The first arm 131 has a disk shape. The first arm 131 is a rigid structure. The first arm 131 attaches to the perimeter of the crossplate 133 such that the congruent ends of the disk structure of the first arm 131 project perpendicularly away from the congruent ends of the disk structure of the crossplate 133.

The second arm 132 is a prism-shaped structure. The second arm 132 has a disk shape. The second arm 132 is a rigid structure. The second arm 132 attaches to the perimeter of the crossplate 133 such that the congruent ends of the disk structure of the second arm 132 project perpendicularly away from the congruent ends of the disk structure of the crossplate 133. The second arm 132 attaches to the portion of the perimeter of the crossplate 133 that is distal from the first arm 131. The second arm 132 projects away from the congruent ends of the disk structure of the crossplate 133 in the same direction as the first arm 131. The congruent ends of the disk structure of the first arm 131 are parallel to the congruent ends of the disk structure of the second arm 132.

The span of the perpendicular distance between the interior congruent end of the first arm 131 and the interior congruent end of the second arm 132 is greater than the span of the width of the rail 141 such that the rail 141 hook 103 slides over the rail 141 of the fence 104.

The crossplate 133 is a prism-shaped structure. The crossplate 133 has a disk shape. The crossplate 133 is a rigid structure. The crossplate 133 secures the first arm 131 to the second arm 132. The crossplate 133 forms surface of the invention 100 with the greatest elevation.

The free end of the first arm 131 of the rail 141 hook 103 attaches to the counter plate 101. Specifically, the exterior congruent end of the disk structure of the first arm 131 attaches to the first plurality of lateral faces 113 of the counter plate 101. The first arm 131 attaches to the counter plate 101 such that the congruent ends of the disk structure of the first arm 131 project perpendicularly away from the congruent ends of the disk structure of the counter plate 101. The first arm 131 attaches to the counter plate 101 such that the first arm 131 projects away from the first superior face 111 of the counter plate 101 such that the counter plate 101 in the direction away from the bracing plate 102.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Approximate: As used in this disclosure, the term approximate refers to the difference between the exact value of the parameter of an object that sets the standard and the measured value of the same parameter on a duplication of the object. The difference is considered approximate if a person skilled in the art would not consider the difference to have practical significance.

C-Channel: As used in this disclosure, the C-channel is a load bearing structure, such as a beam, that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Mass: As used in this disclosure, the center of mass refers to a point within a structure wherein a force applied to the point will cause the structure to move without rotation. The center of mass is commonly, but not always, the first moment of the structure normalized by the mass of the structure. While there are technical differences, the center of gravity of an object can be considered a synonym for the center of mass when the object is contained within the atmosphere of the earth.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Counter: As used in this disclosure, a counter is a horizontal surface that: a) attaches to a vertically oriented surface or structure; and, b) is used as a working space for projects. A counter is further defined with an inferior surface and a superior surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Fence: As used in this disclosure, a fence is a barrier structure that encloses an outdoor space for the purposes of: 1) establishing a boundary; or, 2) controlling access into or out of the enclosed space. The boundary formed by a fence is referred to as a fence line.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Ledge: As used in this disclosure, a ledge is a first plate structure that projects away from a second plate structure. A ledge that projects away from, or overhangs, the second plate structure in the manner of a cantilever is referred to as an undercut ledge.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Picket: As used in this disclosure, a picket of a fence is a vertical plate structure that: 1) is attached to the rails of a fence; and, 2) forms the primary barrier structure of the fence.

Post: As used in this disclosure, a post of a fence is a stanchion that is: 1) set into the ground; and 2) provides the vertical structural support for the fence.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rail: As used in this disclosure, the rail of a fence is a horizontal structural member that: 1) attaches to one or more posts of the fence; and, 2) forms the structure to which the pickets of the fence are attached.

Rigid Structure: As used in this disclosure, a rigid structure is a solid structure formed from an inelastic material that resists changes in shape. A rigid structure will permanently deform as it fails under a force. See bimodal flexible structure.

Roughly: As used in this disclosure, roughly refers to a comparison between two objects. Roughly means that the difference between one or more parameters of the two compared objects are not significantly different.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path. See Sling U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rail-mounted tabletop comprising
a counter plate, a bracing plate, and a rail hook;
wherein the bracing plate and the rail hook attach to the counter plate;
wherein the rail-mounted tabletop is a table;
wherein the rail-mounted tabletop is configured for use with a fence;
wherein the rail-mounted tabletop is suspended from the rail of the fence;
wherein the counter plate forms a horizontally oriented supporting surface;
wherein the rail hook suspends the counter plate and the bracing plate from the fence;
wherein the bracing plate braces the counter plate against the fence;
wherein the counter plate comprises a first superior face, a first inferior face, and a first plurality of lateral faces;
wherein the bracing plate comprises a second superior face, a second inferior face, and a second plurality of lateral faces;
wherein the rail hook comprises a first arm, a second arm, and a crossplate;
wherein the first superior face forms the horizontal surface used to support objects in a position elevated above the supporting surface;
wherein the second superior face forms the surface of the bracing plate that attaches to the first inferior face of the counter plate.

2. The rail-mounted tabletop according to claim 1;
wherein the fence is configured to form the final link of the load path that transfers the load of the rail-mounted tabletop to the supporting surface;
wherein a plurality of pickets and posts of the fence is configured to form a load path that transfers the load of the rail-mounted tabletop to the supporting surface;
wherein the rail hook is configured to suspend the counter plate and the bracing plate from a rail of said fence;
wherein the bracing plate is configured to brace the counter plate against the plurality of pickets and posts of the fence.

3. The rail-mounted tabletop according to claim 2
wherein the counter plate is a structure;
wherein the counter plate has a disk structure;
wherein the counter plate is a rigid structure;
wherein the counter plate forms a horizontal surface used to support objects in a position elevated above the supporting surface.

4. The rail-mounted tabletop according to claim 3
wherein the bracing plate has a disk structure;
wherein the bracing plate is a rigid structure;
wherein the bracing plate forms the inferior structure of the rail-mounted tabletop.

5. The rail-mounted tabletop according to claim 4 wherein the bracing plate attaches to the counter plate such that the bracing plate projects beyond a first plurality of lateral faces of the counter plate to form an undercut ledge structure.

6. The rail-mounted tabletop according to claim 5 wherein the bracing plate and the counter plate are positioned relative to the rail hook such that the center of mass of the rail-mounted tabletop is not positioned on the plane formed by the fence.

7. The rail-mounted tabletop according to claim 6 wherein the rail hook is a mechanical structure;
wherein the rail hook is a c-channel structure;
wherein the rail hook forms the superior structure of the rail-mounted tabletop;
wherein the rail hook attaches the counter plate and the bracing plate to the rail of the fence;
wherein the rail hook suspends the counter plate and the bracing plate from the rail.

8. The rail-mounted tabletop according to claim 7 wherein the rail hook attaches to the rail by inserting the rail into the hollow interior of the c-channel structure of the rail hook.

9. The rail-mounted tabletop according to claim 8
wherein the first superior face is a congruent end of the disk structure of the counter plate;
wherein the first inferior face is a congruent end of the disk structure of the counter plate;
wherein the first plurality of lateral faces form the lateral faces of the disk structure of the counter plate;
wherein the first plurality of lateral faces form the perimeter of the counter plate.

10. The rail-mounted tabletop according to claim 9
wherein the second superior face is a congruent end of the disk structure of the bracing plate;
wherein the second inferior face is a congruent end of the disk structure of the bracing plate;
wherein the second plurality of lateral faces form the lateral faces of the disk structure of the bracing plate.

11. The rail-mounted tabletop according to claim 10 wherein the bracing plate attaches to the counter plate to form an undercut ledge.

12. The rail-mounted tabletop according to claim 11
wherein the crossplate secures the first arm to the second arm;
wherein the first arm forms the first arm of the u-shaped structure characteristic of a c-channel structure such as the rail hook;
wherein the second arm forms the second arm of the u-shaped structure characteristic of a c-channel structure such as the rail hook;
wherein the crossplate forms the crossbeam of the u-shaped structure characteristic of a c-channel structure such as the rail hook.

13. The rail-mounted tabletop according to claim 12
wherein the first inferior face is the congruent end of the disk structure of the counter plate that is distal from the first superior face;
wherein the first inferior face is the congruent end of the disk structure of the counter plate that is proximal to the supporting surface;
wherein the bracing plate attaches to the first inferior face of the counter plate.

14. The rail-mounted tabletop according to claim 13
wherein the second inferior face is the congruent end of the disk structure of the bracing plate that is distal from the second superior face;
wherein the second inferior face is the congruent end of the disk structure of the bracing plate that is proximal to the supporting surface;
wherein the second inferior face forms the inferior surface of the rail-mounted tabletop;
wherein the second plurality of lateral faces form the perimeter of the bracing plate.

15. The rail-mounted tabletop according to claim 14
wherein the second superior face of the bracing plate attaches to the first inferior face of the counter plate such that a portion of the perimeter formed by the second plurality of lateral faces extends beyond the region that is bounded by the first plurality of lateral faces;
wherein the portion of the second plurality of lateral faces of the bracing plate that extends beyond the boundary formed by the first plurality of lateral faces of the counter plate forms the undercut ledge structure of the bracing plate;
wherein the portions of the undercut ledge that are distal from the first plurality of lateral faces of the counter plate forms the surfaces of the second plurality of lateral faces of the bracing plate that braces the rail-mounted tabletop by resting against the plurality of pickets and posts of the fence.

16. The rail-mounted tabletop according to claim 15
wherein the first arm has a disk shape;
wherein the first arm is a rigid structure;
wherein the first arm attaches to the perimeter of the crossplate such that the congruent ends of the disk structure of the first arm project perpendicularly away from the congruent ends of the disk structure of the crossplate.

17. The rail-mounted tabletop according to claim 16
wherein the second arm has a disk shape;
wherein the second arm is a rigid structure;
wherein the second arm attaches to the perimeter of the crossplate such that the congruent ends of the disk structure of the second arm project perpendicularly away from the congruent ends of the disk structure of the crossplate;
wherein the second arm attaches to the portion of the perimeter of the crossplate that is distal from the first arm.

18. The rail-mounted tabletop according to claim 17
wherein the second arm projects away from the congruent ends of the disk structure of the crossplate in the same direction as the first arm;
wherein the congruent ends of the disk structure of the first arm are parallel to the congruent ends of the disk structure of the second arm;
wherein the span of the perpendicular distance between the interior congruent end of the first arm and the interior congruent end of the second arm is greater than the span of the width of the rail such that the rail hook slides over the rail of the fence.

19. The rail-mounted tabletop according to claim 18
wherein the crossplate has a disk shape;
wherein the crossplate is a rigid structure;
wherein the crossplate forms surface of the rail-mounted tabletop with the greatest elevation.

20. The rail-mounted tabletop according to claim 19
wherein the free end of the first arm of the rail hook attaches to the counter plate;
wherein the exterior congruent end of the disk structure of the first arm attaches to the first plurality of lateral faces of the counter plate;
wherein the first arm attaches to the counter plate such that the congruent ends of the disk structure of the first arm project perpendicularly away from the congruent ends of the disk structure of the counter plate;
wherein the first arm attaches to the counter plate such that the first arm projects away from the first superior face of the counter plate such that the counter plate in the direction away from the bracing plate.

* * * * *